US011268512B2

(12) United States Patent
Pandzik et al.

(10) Patent No.: US 11,268,512 B2
(45) Date of Patent: Mar. 8, 2022

(54) FLUID MACHINE WITH HELICALLY LOBED ROTORS

(71) Applicant: Carrier Corporation, Palm Beach Gardens, FL (US)

(72) Inventors: Richard T. Pandzik, Syracuse, NY (US); Masao Akei, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 151 days.

(21) Appl. No.: 16/473,185

(22) PCT Filed: Jan. 11, 2018

(86) PCT No.: PCT/US2018/013367
§ 371 (c)(1),
(2) Date: Jun. 24, 2019

(87) PCT Pub. No.: WO2018/132601
PCT Pub. Date: Jul. 19, 2018

(65) Prior Publication Data

US 2019/0331113 A1 Oct. 31, 2019

Related U.S. Application Data

(60) Provisional application No. 62/444,850, filed on Jan. 11, 2017.

(51) Int. Cl.
*F03C 2/00* (2006.01)
*F03C 4/00* (2006.01)
(Continued)

(52) U.S. Cl.
CPC ..... *F04C 18/165* (2013.01); *F04C 18/084* (2013.01); *F04C 23/001* (2013.01);
(Continued)

(58) Field of Classification Search
CPC ..... F04C 18/084; F04C 18/16; F04C 18/165; F04C 23/001; F04C 29/023;
(Continued)

(56) References Cited

U.S. PATENT DOCUMENTS 2,410,172 A * 10/1946 Lysholm ..... F04C 18/165 418/202
2,714,857 A 8/1955 Albright et al.
(Continued)

FOREIGN PATENT DOCUMENTS

CN 201358919 Y 12/2009
CN 101793251 A 8/2010
(Continued)

OTHER PUBLICATIONS

International Search Report and Written Opinion for application PCT/US2018/013367, dated May 18, 2018, U301770PCT, 16 pages.

*Primary Examiner* — Theresa Trieu
(74) *Attorney, Agent, or Firm* — Cantor Colburn LLP

(57) ABSTRACT

A fluid machine includes a first rotor having a first rotor first working portion and a first rotor second working portion, a second rotor having a second rotor first working portion configured to mesh with the first rotor first working portion and a second rotor second working portion configured to mesh with the first rotor second working portion and rotate independently from the second rotor first working portion.

11 Claims, 2 Drawing Sheets

(51) Int. Cl.

| | |
|---|---|
| ***F04C 11/00*** | (2006.01) |
| ***F04C 2/00*** | (2006.01) |
| ***F04C 18/16*** | (2006.01) |
| ***F04C 18/08*** | (2006.01) |
| ***F04C 29/02*** | (2006.01) |
| ***F04C 23/00*** | (2006.01) |

(52) U.S. Cl.
CPC ..... *F04C 29/023* (2013.01); *F04C 2240/20* (2013.01); *F04C 2240/603* (2013.01)

(58) Field of Classification Search
CPC ..... F04C 2230/601; F04C 2230/603; F04C 2240/20; F04C 2240/54; F04C 2240/60; F04C 2240/603; F04C 2240/605; F04C 2240/809; F01C 1/16; F01C 1/165; F01C 1/18; F01C 1/20; F01C 21/02
See application file for complete search history.

(56) References Cited

U.S. PATENT DOCUMENTS

| | | | | |
|---|---|---|---|---|
| 3,182,900 | A | 5/1965 | Thorson | |
| 3,667,879 | A * | 6/1972 | Cerpelli | F04C 18/165 418/202 |
| 3,796,526 | A | 3/1974 | Cawley | |
| 3,811,805 | A | 5/1974 | Moody, Jr. et al. | |
| 3,922,114 | A | 11/1975 | Hamilton et al. | |
| 5,393,209 | A * | 2/1995 | Mohr | F04C 18/165 418/202 |
| 5,624,249 | A * | 4/1997 | Rohlfing | F04C 18/165 418/202 |
| 5,662,463 | A | 9/1997 | Mirzoev et al. | |
| 5,738,505 | A * | 4/1998 | Mezzedimi | F04C 18/165 418/202 |
| 6,050,797 | A | 4/2000 | Zhong | |
| 6,093,008 | A | 7/2000 | Kirsten | |
| 8,876,505 | B2 | 11/2014 | Nachtergaele et al. | |
| 2002/0048524 | A1* | 4/2002 | Graber, Jr. | F04C 18/165 418/202 |
| 2008/0031761 | A1* | 2/2008 | North | F04C 29/023 418/94 |

FOREIGN PATENT DOCUMENTS

| | | | |
|---|---|---|---|
| CN | 101818730 | A | 9/2010 |
| CN | 104912809 | A | 9/2015 |
| CN | 105805002 | A | 7/2016 |
| CN | 205618356 | U | 10/2016 |
| DE | 1192055 | U | 4/1965 |
| DE | 19748385 | A1 | 5/1999 |
| DE | 19820622 | A1 | 11/1999 |
| JP | 4171291 | B2 | 10/2008 |
| WO | 2016099746 | A1 | 6/2016 |
| WO | 2016164989 | A1 | 10/2016 |

* cited by examiner

FLUID MACHINE WITH HELICALLY LOBED ROTORS

CROSS REFERENCE TO RELATED APPLICATION

The present application is an international patent application, and claims the priority benefit of, U.S. Application Ser. No. 62/444,850, filed Jan. 11, 2017, the text and drawings of which are hereby incorporated by reference in its entirety.

TECHNICAL FIELD OF THE DISCLOSED EMBODIMENTS

The presently disclosed embodiments generally relate to fluid machines and, more particularly, fluid machines with helically lobed rotors.

BACKGROUND OF THE DISCLOSED EMBODIMENTS

It has been determined that commonly used refrigerants, such as R-410A in one non-limiting example, have unacceptable global warming potential (GWP) such that their use will cease for many HVAC/R applications. Non-flammable, low GWP refrigerants are replacing existing refrigerants in many applications, but have lower density and do not possess the same cooling capacity as existing refrigerants. Replacement refrigerants require a compressor capable of providing a significantly greater displacement, such as a screw compressor.

Existing screw compressors typically utilize roller, ball, or other rolling element bearings to precisely position the rotors and minimize friction during high speed operation. However, for typical HVAC/R applications, existing screw compressors with rolling element bearings result in an unacceptably large and costly fluid machine.

Therefore, there exists a need in the art for an appropriately sized and cost effective fluid machine that minimizes friction while allowing precise positioning and alignment of the rotors.

SUMMARY OF THE DISCLOSED EMBODIMENTS

In accordance with an embodiment of the present disclosure, a fluid machine is provided. The fluid machine includes a first rotor having a first rotor first working portion and a first rotor second working portion, and a second rotor having a second rotor first working portion configured to mesh with the first rotor first working portion and a second rotor second working portion configured to mesh with the first rotor second working portion and rotate independently from the second rotor first working portion.

The fluid machine may further include a first shaft fixed for rotation with the first rotor. The fluid machine may further include a casing rotatably supporting the first shaft and at least partially enclosing the first rotor and the second rotor. The fluid machine may further include a second shaft having a shaft diameter and configured to rotationally support the second rotor. The second rotor may include an axially-extending bore having a bore diameter greater than the shaft diameter. The fluid machine may further include an axially-extending passage defined between the shaft diameter and the bore diameter, the passage circulating lubricant therethrough. At least one of the first shaft and the second shaft may include an axial shaft passage having an axial shaft passage diameter. The at least one of the first shaft and the second shaft may include a shaft diameter, and the axial shaft passage diameter may be less than approximately 80% of the shaft diameter. At least one of the first shaft and the second shaft may include a radially-extending shaft passage having a radially-extending shaft passage diameter. The at least one of the first shaft and the second shaft may include a shaft diameter, and the radially-extending shaft passage diameter may be less than approximately 40% of the shaft diameter. The first portion may axially abut the second portion. The first rotor first working portion, the first rotor second working portion, the second rotor first working portion, and the second rotor second working portion may include helical lobes.

In accordance with an embodiment of the present disclosure, a fluid machine is provided having a first rotor having helical lobes, a first shaft fixed for rotation with the first rotor and configured to be rotatably supported by a casing at a first end and a second end of the casing, a second rotor having helical lobes and an axially-extending bore having a bore diameter, and a second shaft having a second shaft diameter that is less than the bore diameter and configured to rotationally support the second rotor.

The second rotor may include a first portion axially abutting a second portion such that the first portion is configured to rotate independently from the second portion. The fluid machine may further include an axially-extending passage defined between the second shaft diameter and the bore diameter, the passage circulating lubricant therethrough. The second shaft may be fixed for rotation with the casing. The first rotor may include first helical lobes and second helical lobes, and the second rotor may include a first portion configured to mesh with the first helical lobes and a second portion configured to mesh with the second helical lobes and rotate independently from the first portion. At least one of the first shaft and the second shaft may include an axial shaft passage having an axial shaft passage diameter. The first shaft may include a first shaft diameter, and the axial shaft passage diameter may be less than approximately 80% of at least one of the first shaft diameter and the second shaft diameter. At least one of the first shaft and the second shaft may include a radially-extending shaft passage having a radially-extending shaft passage diameter. The first shaft may include a first shaft diameter, and the radially-extending shaft passage diameter may be less than approximately 40% of at least one of the first shaft diameter and the second shaft diameter.

BRIEF DESCRIPTION OF DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
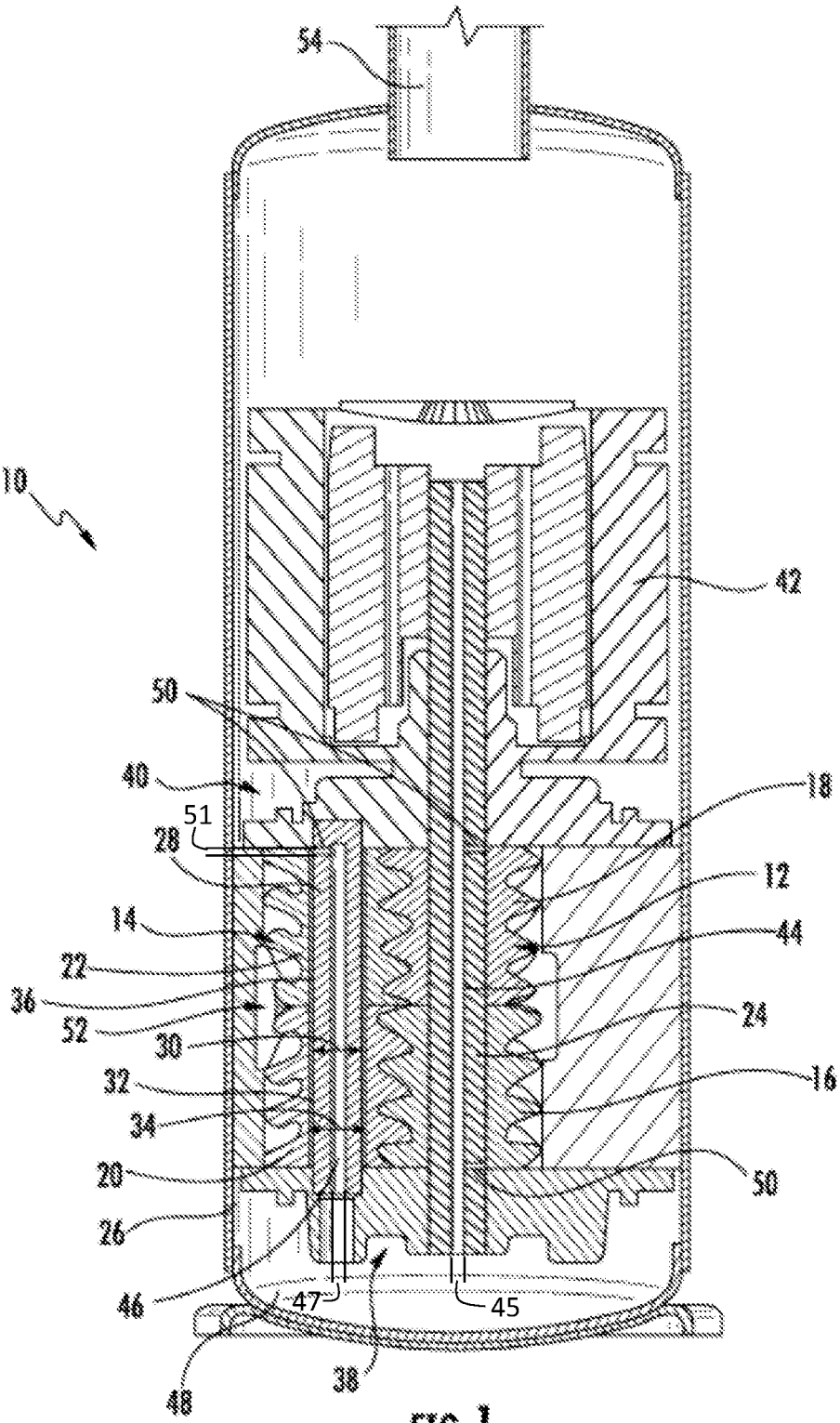
FIG. 1 is a cross-sectional view of a fluid machine in accordance with an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring now to FIG. 1, a fluid machine 10 of an embodiment of the present disclosure is illustrated. The fluid machine 10 of the embodiment illustrated is an opposed screw compressor. In one or more embodiments not illustrated, the fluid machine 10 is a pump, fluid motor, engine, or any other fluid machine known by a person having ordinary skill in the art. The exemplary fluid machine 10 includes a first rotor 12 enmeshed with a second rotor 14. In an embodiment, the first rotor 12 is a male rotor having a male-lobed working portion and the second rotor 14 is a female rotor. In another embodiment, the first rotor 12 is a female rotor and the second rotor 14 is a male rotor. The first rotor 12 of the embodiment illustrated in FIG. 1 includes first helical lobes 16 and second helical lobes 18.

The exemplary fluid machine 10 of the embodiment illustrated in FIG. 1 includes a first shaft 24 fixed for rotation with the first rotor 12. The fluid machine 10 further includes a casing 26 rotatably supporting the first shaft 24 and at least partially enclosing the first rotor 12 and the second rotor 14. A first end 38 and a second end 40 of the casing 26 are configured to rotatably support the first shaft 24. The first shaft 24 of the illustrated embodiment is directly coupled to an electric motor 42 (e.g., induction, permanent magnet (PM), or switch reluctance) configured to drive the first shaft 24. In an embodiment, the first rotor 12 is fixed to the first shaft 24 by fastener, integral formation, interference fit, and/or any additional structures or methods known to one having ordinary skill in the art.

The fluid machine 10 includes a second shaft 28 having a shaft diameter 30 and is configured to rotationally support the second rotor 14. The second rotor 14 includes an axially-extending bore 32 having a bore diameter 34 greater than the shaft diameter 30.

Figure 2:
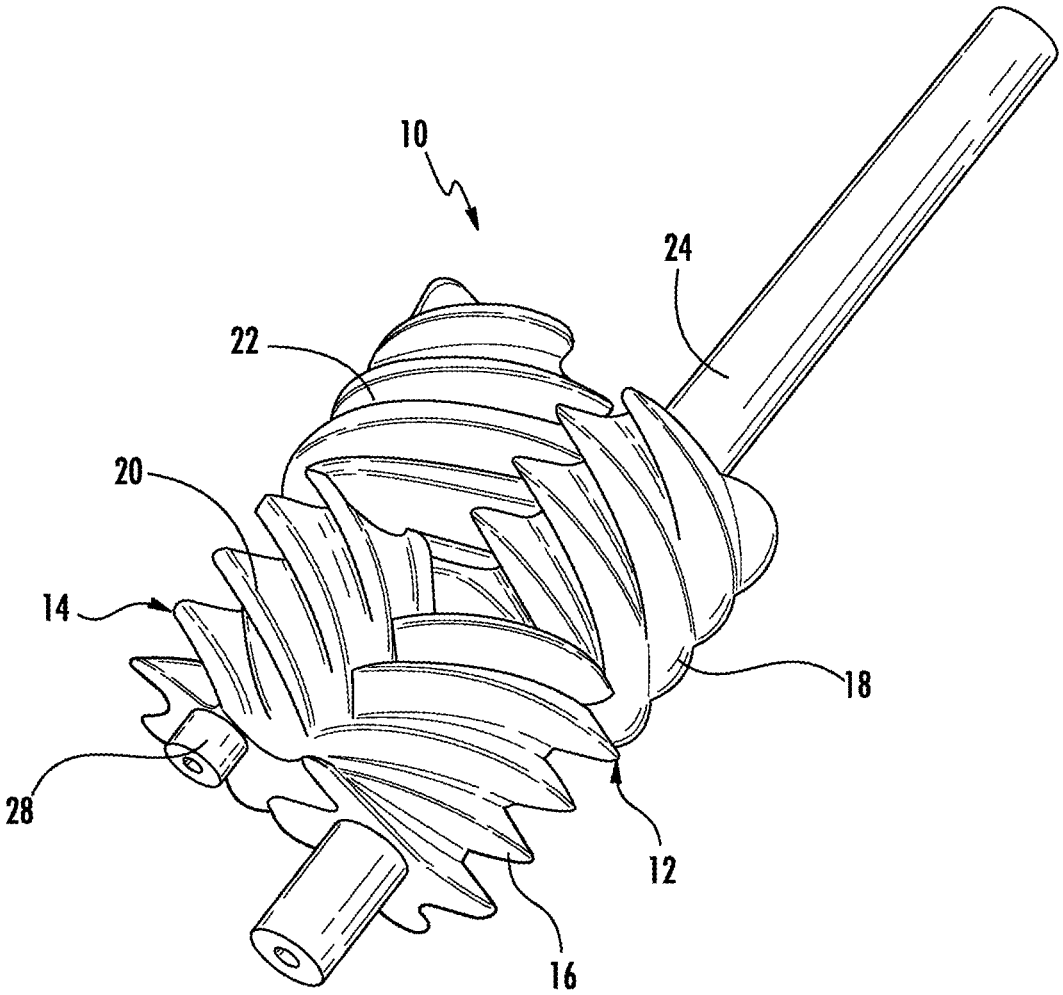
FIG. 2 is a perspective view of a fluid machine in accordance with an embodiment of the present disclosure.

Referring now to FIG. 2, there are four first helical lobes 16 and four second helical lobes 18 in the embodiment illustrated. One of ordinary skill in the art will recognize that the first helical lobes 16 and the second helical lobes 18 may include any number of lobes in one or more embodiments of the present disclosure. The first helical lobes 16 and the second helical lobes 18 are configured to have opposite helical directions. In the embodiment illustrated in FIG. 2, the first helical lobes 16 are right-handed and the second helical lobes 18 are left-handed. In another embodiment, the first helical lobes 16 are left-handed and the second helical lobes 18 are right-handed. Having opposite helical directions between the first helical lobes 16 and the second helical lobes 18 will create opposing axial flows between the helical lobes 16 and 18. Due to the symmetry of the axial flows, thrust forces between the helical lobes 16 and 18 can be nearly cancelled. This configuration of the opposing helical rotors has a design advantage as it can reduce the need of thrust bearings in the fluid machine. The second rotor 14 has a first portion 20 configured to mesh with the first helical lobes 16 and a second portion 22 configured to mesh with the second helical lobes 18. In order to mesh the first rotor 12 and the second rotor 14 properly, the second rotor 14 must have opposite helical directions from the first rotor 12. In the illustrated embodiment in FIG. 2, the first portion 20 of the second rotor 14 is left-handed and the second portion 22 of the second rotor 14 is right-handed. In another embodiment, the first portion 20 of the second rotor 14 is right-handed and the second portion 22 of the second rotor is left-handed. In an embodiment, the first portion 20 is configured to rotate independently from the second portion 22 by virtue of at least the passage 36 (shown in FIG. 1), described in further detail below, being configured to allow lubricant to pass or circulate between the first and second portions 20, 22 and the second shaft 28, thereby forming internal bearing surfaces between each of the first and second portions 20, 22 and the second shaft 28. One of ordinary skill in the art will recognize that the first portion 20 and the second portion 22 may include any number of lobes in one or more embodiments of the present disclosure. In an embodiment, the first portion 20 axially abuts the second portion 22. In the embodiment illustrated, the first rotor 12 includes two separate portions defining the first helical lobes 16 and the second helical lobes 18. In another embodiment not illustrated, the first rotor 12 is a single, integral piece.

Returning to FIG. 1, during operation of the fluid machine 10 of one embodiment, a gas or other fluid, such as a low GWP refrigerant to name one non-limiting example, is drawn to a central location 52 by a suction process generated by the fluid machine 10. One will recognize that the rotation of the first rotor 12 and the second rotor 14 compresses the refrigerant toward outer ends 38, 40 of the casing 26 between the sealed surfaces of the meshed rotors 12, 14 due to the structure and function of the opposing helical rotors 12, 14. The compressed refrigerant is routed by an internal gas passage (not shown) within the casing 26 and discharged through the upper end 40 of the casing 26. The discharged refrigerant passes through the electric motor 42 and out of the discharge outlet 54.

Referring again to FIG. 1, in an embodiment, the fluid machine 10 includes a first shaft passage 44 extending axially through the first shaft 24 and a second shaft passage 46 extending axially through the second shaft 28. The first shaft passage 44 and/or the second shaft passage 46 communicate lubricant from a sump 48, through first shaft 24 and/or second shaft 28, out one or more radial passages 50, and along one or more surfaces of the first rotor 12 and/or the second rotor 14. The fluid machine 10 further includes an axially-extending passage 36 defined between the shaft diameter 30 and the bore diameter 34 of the second rotor 14. The passage 36 is configured to allow lubricant to pass or circulate therethrough. In an embodiment, relatively high pressure discharge at outer ends 38, 40 of the casing 26, the first rotor 12, and the second rotor 14 and relatively low pressure suction at the central location 52 of the first rotor 12 and the second rotor 14 urge lubricant through the passage 36. The circulation of lubricant through the passage 36 provides internal bearing surfaces between each of the first and second portions 20, 22 and the second shaft 28 to reduce friction therebetween and further allow the first portion 20 of the second rotor 14 to rotate independently of the second portion 22 of the second rotor 14.

The axial shaft passages 44 and 46 of one or more embodiments include a diameter being greater than 3 mm in order to maintain sufficient lubricant flow. In an additional embodiment, the axial shaft passages 44 and 46 include a diameter, 45 and 47, respectively, being less than or equal to 3 mm. The axial shaft passages 44 and 46 of one or more embodiments do not exceed more than approximately 80 percent of the outer diameters of the respective shafts 24 and 28 in order to maintain rigidity of the first and second shafts 24 and 28. In an additional embodiment, the axial shaft passages 44 and 46 exceed more than approximately 80 percent of the outer diameters of the respective shafts 24 and 28. The diameter, 51, of the radial shaft passages 50 in one or more embodiments is greater than approximately 1 mm but less than approximately 40% of the outer diameters of 24 and 28 in order to maintain rigidity of the first and second shafts 24 and 28. In additional embodiments, the diameter of the radial shaft passages 50 is less than approximately 1 mm and/or greater or equal to approximately 40% of the outer diameters of 24 and 28.

One will appreciate that the embodiments described in the present disclosure enable the practical use of opposing screw rotors to balance thrust forces. Further, the embodiments described herein reduce or eliminate the necessity to precisely align rotors circumferentially. For example, the female rotors of one or more embodiments described herein align the male rotors independently to reduce or eliminate the necessity to precisely align the male rotors. Such alignment advantages facilitate and improve manufacturability as well as offset compression processes to reduce torque variation, pressure pulsations, noise, and/or vibration. One will also recognize that the embodiments described herein simplify the assembly of the mechanism by allowing the separate rotors to be separately assembled.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A fluid machine comprising:

a first rotor having a first rotor first working portion and a first rotor second working portion; and a second rotor having a second rotor first working portion configured to mesh with the first rotor first working portion and a second rotor second working portion configured to mesh with the first rotor second working portion and rotate independently from the second rotor first working portion;

a first shaft fixed for rotation with the first rotor;

a second shaft having a shaft diameter and configured to rotationally support the second rotor;

wherein the second rotor includes an axially-extending bore having a bore diameter greater than the shaft diameter;

wherein the second rotor first working portion axially abuts the second rotor first second working portion.

2. The fluid machine of claim 1, further comprising a casing rotatably supporting the first shaft and at least partially enclosing the first rotor and the second rotor.

3. The fluid machine of claim 1, further comprising an axially-extending passage defined between the shaft diameter and the bore diameter, the axially-extending passage circulating lubricant therethrough.

4. The fluid machine of claim 1, wherein at least one of the first shaft and the second shaft includes an axial shaft passage having an axial shaft passage diameter.

5. The fluid machine of claim 4, wherein the at least one of the first shaft and the second shaft includes a shaft diameter, and the axial shaft passage diameter is less than 80% of the shaft diameter.

6. The fluid machine of claim 1, wherein at least one of the first shaft and the second shaft includes a radially-extending shaft passage having a radially-extending shaft passage diameter.

7. The fluid machine of claim 6, wherein the at least one of the first shaft and the second shaft includes a shaft diameter, and the radially-extending shaft passage diameter is less than 40% of the shaft diameter.

8. The fluid machine of claim 1, wherein the first rotor first working portion, the first rotor second working portion, the second rotor first working portion, and the second rotor second working portion include helical lobes.

9. The fluid machine of claim 1, wherein the second shaft is fixed for rotation with the casing.

10. The fluid machine of claim 1, wherein the first rotor includes first helical lobes and second helical lobes, and the second rotor includes a first portion configured to mesh with the first helical lobes and a second portion configured to mesh with the second helical lobes and rotate independently from the first portion.

11. The fluid machine of claim 1, wherein both the first shaft and the second shaft include a radially-extending shaft passage having a radially-extending shaft passage diameter.

* * * * *